US009409192B2

(12) United States Patent
Herre

(10) Patent No.: US 9,409,192 B2
(45) Date of Patent: Aug. 9, 2016

(54) DEVICE AND METHOD FOR PRESERVING COMPONENTS

(75) Inventor: Frank Herre, Oberriexingen (DE)

(73) Assignee: Duerr Systems GmbH, Bietigheim-Bissingen (DE)

( * ) Notice: Subject to any disclaimer, the term of this patent is extended or adjusted under 35 U.S.C. 154(b) by 1060 days.

(21) Appl. No.: 13/509,110

(22) PCT Filed: Nov. 11, 2010

(86) PCT No.: PCT/EP2010/006880
§ 371 (c)(1),
(2), (4) Date: Jul. 16, 2012

(87) PCT Pub. No.: WO2011/057785
PCT Pub. Date: May 19, 2011

(65) Prior Publication Data

US 2012/0282405 A1 Nov. 8, 2012

(30) Foreign Application Priority Data

Nov. 11, 2009 (DE) ..... 10 2009 052 654

(51) Int. Cl.
*B05C 5/00* (2006.01)
*B05B 7/06* (2006.01)
*B05B 7/04* (2006.01)
(Continued)

(52) U.S. Cl.
CPC ..... *B05B 7/061* (2013.01); *B01F 5/0256* (2013.01); *B05B 7/0408* (2013.01); *B05B 7/0846* (2013.01); *B05B 13/0627* (2013.01); *B01F 2215/0039* (2013.01); *B05B 13/0431* (2013.01); *B05B 13/0452* (2013.01);
(Continued)

(58) Field of Classification Search
CPC .... B05B 7/0408; B05B 7/061; B05B 7/0846; B05B 7/2472; B05B 7/2443; B05B 1/267; B05B 13/0627; B05B 13/0431; B05B 13/0457; B05B 13/0452; B05C 5/00; B05C 5/027
USPC ..... 239/304, 399, 407, 306, 418, 305, 239/433–434.5; 118/300, 302, 313, 314, 118/323
See application file for complete search history.

(56) References Cited

U.S. PATENT DOCUMENTS 4,458,831 A 7/1984 Holleran et al.
4,703,894 A 11/1987 Fukuta et al.
(Continued)

FOREIGN PATENT DOCUMENTS

CN 101250372 A 8/2008
DE 3142154 A1 5/1983
(Continued)

OTHER PUBLICATIONS

International Search Report, PCT/EP2010/006880, Dated Feb. 15, 2011.
(Continued)

*Primary Examiner* — Laura Edwards
(74) *Attorney, Agent, or Firm* — Bejin Bieneman PLC

(57) ABSTRACT

Devices for preserving components with a preservative agent, e.g., for cavity preservation of motor vehicle body components, are disclosed. An exemplary device, in addition to a preservative agent, may apply a hardener configured to react with the preservative agent, which causes the preservative agent to harden.

21 Claims, 4 Drawing Sheets

(51) Int. Cl.

| | |
|---|---|
| ***B05B 7/08*** | (2006.01) |
| ***B05B 13/06*** | (2006.01) |
| ***B01F 5/02*** | (2006.01) |
| *B05C 5/02* | (2006.01) |
| *B05B 13/04* | (2006.01) |

(52) U.S. Cl.

CPC ..... *B05B 13/0457* (2013.01); *B05C 5/00* (2013.01); *B05C 5/027* (2013.01)

(56) References Cited

U.S. PATENT DOCUMENTS

| | | | | |
|---|---|---|---|---|
| 5,071,683 | A * | 12/1991 | Verwilst et al. | 427/420 |
| 2002/0148904 | A1* | 10/2002 | Yu | 239/69 |
| 2004/0038040 | A1* | 2/2004 | Schumann | C09J 7/0246 428/423.1 |
| 2004/0094865 | A1* | 5/2004 | Mellentine et al. | 264/240 |
| 2007/0267443 | A1* | 11/2007 | Rub et al. | 222/145.5 |

FOREIGN PATENT DOCUMENTS

| | | | |
|---|---|---|---|
| DE | 3518584 | A1 | 11/1985 |
| DE | 3616235 | A1 | 11/1987 |
| DE | 10320341 | A1 | 6/2004 |
| DE | 10322170 | A1 | 12/2004 |
| DE | 102008011489 | A1 | 8/2009 |
| EP | 1795282 | A1 | 6/2007 |
| EP | 2067530 | A1 | 6/2009 |
| EP | 2098302 | A1 | 9/2009 |
| GB | 986710 | * | 2/1965 |
| GB | 2251396 | A | 7/1992 |

OTHER PUBLICATIONS

Jiexiu Liu: "Spray cere technics and equipments for the cavity of HNSAE06034-Bus Body Frame", Manufacture and testing technology, pp. 105-106.

* cited by examiner

DEVICE AND METHOD FOR PRESERVING COMPONENTS

CROSS-REFERENCES TO RELATED APPLICATIONS

This application is a National Stage application which claims the benefit of International Application No. PCT/EP2010/006880 filed Nov. 11, 2010, which claims priority based on German Application No. DE 10 2009 052 654.4, filed Nov. 11, 2009, both of which are hereby incorporated by reference in their entireties.

BACKGROUND

The present disclosure relates to a device and a method for preserving components with a preservative agent. The exemplary illustrations may be used, for example, in the preservation of hard-to-reach surfaces to be preserved, which may be the case e.g. in cavity preservation, seam sealing (e.g. flange seams), etc. of motor vehicle body components.

Cavity preservation, i.e. the preservation of an inner surface of a cavity, is generally used with high quality vehicles to significantly extend the corrosion protection. The use of cavity preservation is typical, particularly, in countries in which high commitments are made with regard to the so-called "rust-through warranty" (corrosion protection warranty), as is the case in many European countries. Some vehicles which are imported into such countries, if they have not already undergone cavity preservation, undergo cavity preservation retroactively.

Cavity preservation generally must not be omitted in some cases, e.g., in the case of high quality vehicles with high corrosion protection warranties.

There are essentially two methods known for the cavity preservation of motor vehicle bodies, namely the flood-coating method and the spray method.

In the flood-coating method, the cavities of the motor vehicle body to be preserved are flooded with solvent-free wax which has been made liquid by heating, wherein a portion of the wax deposits on the cavity walls and thereby preserves them while the excess wax runs off.

In the spray method for cavity preservation, however, the wax used as the preservative agent is sprayed onto the inner walls of the cavities, for which purpose can be used an application tube (lance), for example, which is inserted from the outside into the cavity and which has outlet openings for the wax.

A wax is usually used as the material for cavity preservation. Typical in the prior art is a processing method wherein the wax is pre-atomized together with air in an pre-atomizing chamber and is fed to the body by means of air through tubes (e.g. having a length of approximately 3-8 meters). The air serves for the atomization, the transport and the distribution within the cavity. The wax is conveyed into the cavity and should usually seal it. To do so it needs to spread. This is generally supported by a tipping station, which "tips" the body part such as to support the spreading (penetration) of the wax. Openings (outlet holes) in the body part to be preserved indicate that the cavity has been successfully coated.

A disadvantage of this method is that escaping wax is undesirable and can contaminate, in particular, subsequent conveyor regions.

This disadvantage is minimized by providing a wax dryer. One known wax dryer heats the body parts to a predetermined minimum temperature over a predetermined minimum period e.g. 1 min. at 60° C. A normal wax dryer length is, merely as an example, 60 minutes. After the drying process, the escaping of wax is essentially stopped. One also speaks in this context of the so-called "drop-stop". The wax may typically harden over a few weeks/days thereafter, but generally does not become completely solid, rather remaining flexible. A series of disadvantages is associated with this type of wax dryer, e.g. high energy consumption during the operation, high investment and/or maintenance costs, high costs of cleaning, large space requirement, cannot be retrofitted in the case of many customers, etc.

The documents DE 35 18 584 A1, GB 2 251 396 A, EP 2 067 530 A1, DE 36 16 235 C2, EP 1 795 282 A1, DE 31 42 154 C2, EP 2 098 302 A1 and U.S. Pat. No. 4,703,894 A provide further technological background.

Accordingly, there is a need for an improved device and an improved method for the preservation of components. It should be possible in particular after the application of the preservative agent and optional subsequent penetration to achieve a "drop-stop" in a generally short time and/or without a dryer resp. furnace. In the case of cavity preservation, for example, there is a need to prevent or minimize preservative agent from escaping from the cavity to be preserved in a simple manner.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
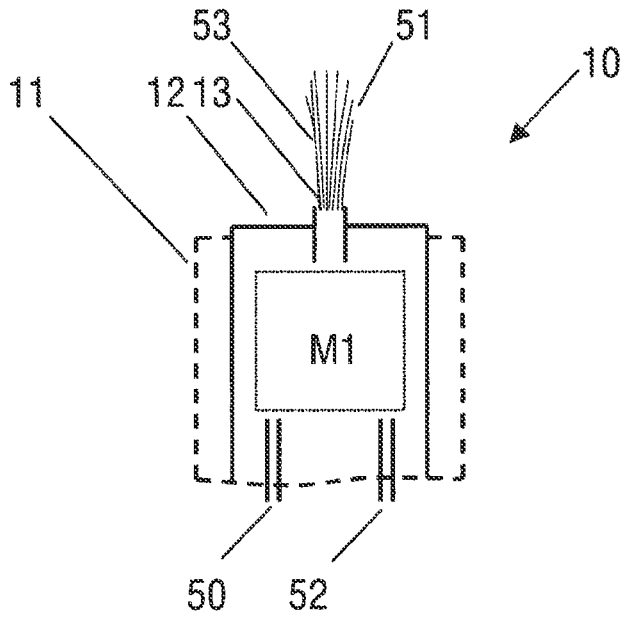
FIG. 1 a schematic representation of a device for preserving components according to a first exemplary illustration.

The exemplary illustrations comprise the general technical teaching to mix a preservative agent and a hardener during the preservation of components in order to cause the preservative agent to harden faster, in particular, to achieve a "drop-stop".

Some exemplary devices herein for preserving components with a preservative agent may be characterized in particular in that, in addition to the preservative agent, a hardener is applied, which reacts with the preservative agent to cause the preservative agent to harden. The devices may thereby be provided in order to apply a hardener in addition to the preservative agent in order to react with the preservative agent, whereby a hardening of the preservative agent is achievable.

In one exemplary illustration, no dryer resp. furnace is required to achieve a "drop-stop".

A further advantage of the exemplary illustrations is that the device can be formed in such a way that no or very few sections of the device come into contact with a mixture of preservative agent and hardener. The preservative agent may harden by means of the hardener after the mixing process. A normal mixer cannot be located directly inside the nozzle for space reasons but would have to be mounted a few centimeters to meters away from the nozzle. Since the hardener reacts with water, the water or the residual moisture from the air/compressed air is sufficient to initiate a reaction. In the process of blowing out the feed line after pre-atomizing and/or mixing, residues would remain in the feed line which could no longer be fully discharged even in the case of subsequent coating processes. Even rinsing would not make the feed line and other contaminated device parts 100% clean. Thus, residues would remain and would harden, which is associated with a series of problems. The following issues are highlighted as being particularly problematic: Clogging of the nozzles, changing of the nozzle geometry by deposits, changing of the application result, malfunction/failure of individual components (e.g. valves), pressure losses, leakages at junctions (e.g. at interchangeable heads), etc. Furthermore, contamination of external geometries can arise due to the atomizing, wherein in particular nozzles, nozzle tubes, interchangeable heads, robot components etc. can be affected. The above problems may generally lead to increased cleaning and maintenance.

According to the exemplary illustrations, the mixing of preservative agent and hardener may take place at an end section of the device in terms of flow, such as in an application device, an application element and/or a nozzle. There is also the possibility of forming the device in such a way that the preservative agent and the hardener can mix after the preservative agent is dispensed from the device, e.g., in flight (in the air), in a cavity to be preserved and/or on a component to be preserved. The initiation of the mixing may take place in an application device, an application element, a nozzle, in flight (in the air), in a cavity to be preserved and/or on a component to be preserved. Consequently, there may advantageously be no mixing of preservative agent and hardener upstream from the application device, upstream from the application element, upstream from a nozzle and/or upstream from an outlet opening of a nozzle. In this way the above disadvantages can be completely avoided or at least significantly diminished.

In particular, the device may comprise an application device for applying the preservative agent and the hardener to the component to be preserved, a preservative agent line for feeding the preservative agent to the application device and a hardener line for feeding the hardener to the application device.

The application device may include at least a first application element with at least one first outlet opening. The first application element may be, for example, an application tube, a lance, a probe, etc.

In one exemplary illustration, the first application element has at least one first nozzle on which is provided the first outlet opening.

The preservative agent line and the hardener line may discharge into the first application element in such a way that the preservative agent and the hardener can be mixed in the first application element. The mixing process can be thereby initiated in the application element. It is advantageous here that only few sections come into contact with a mixture of preservative agent and hardener.

It is also possible that the preservative agent line and the hardener line discharge into the first application element in such a way that the preservative agent and the hardener can be mixed immediately upstream from the first nozzle and/or in the first nozzle. The mixing process can thereby be initiated immediately upstream from the first nozzle and/or in the first nozzle. It is advantageous here that only few sections come into contact with a mixture of preservative agent and hardener.

Furthermore, a second outlet opening can be provided on the first nozzle.

The first application element can furthermore have a second nozzle on which is provided a second outlet opening.

The preservative agent line may lead to the first outlet opening, and the hardener line may lead to the second outlet opening, in such a way that the preservative agent and the hardener mix in flight and/or on the component to be preserved. The mixing process can be thereby initiated in terms of flow downstream from the outlet openings. The preservative agent and the hardener may mix in flight and/or on the component to be preserved. It is advantageous here that no interior sections of the device come into contact with a mixture of preservative agent and hardener.

It is also possible that the application device has a second application element with at least one second outlet opening. The first and second application element may be two separate parts which can be moved and/or controlled independently of one another e.g. can be guided one after the other into a cavity to be preserved. For example, the first application element can be arranged on a first robot arm in a preservative agent application station, whereas the second application element can be arranged on a second robot arm in a hardener application station. The preservative agent application station and the hardener application station may be provided parallel to a conveying route for motor vehicle body components to be preserved.

Similarly to the first application element, the second application element may have a second nozzle on which is provided a second outlet opening.

The preservative agent line may lead to the first outlet opening and the hardener line to the second outlet opening in such a way that the preservative agent and the hardener mix in flight and/or on the surface to be preserved. The mixing process can be thereby initiated in terms of flow downstream from the outlet openings. It is advantageous here that no interior sections of the device come into contact with a mixture of preservative agent and hardener.

The first and/or second application element may be formed in such a way that it can be guided to hard-to-reach surfaces to be preserved (e.g. cavities, undercuts, etc.). The first and/or second application element can be an application tube, a lance, a probe, etc. The first and/or second outlet opening may be provided on this element, e.g., on a nozzle. The application element may be formed in such a way that, e.g., it can be guided through an opening into a cavity to be preserved in order to spray its inner surface to be preserved with preservative agent and/or hardener.

It is furthermore possible to provide a mixer, in particular in the application device, in an application element, e.g., in an application tube, and/or in a nozzle. The mixer can also extend over at least two of the aforementioned sections (e.g. from the application tube to the nozzle). In order to accommodate the mixer e.g. in the nozzle and/or in the application tube, the mixer may have correspondingly small dimensions and nevertheless achieve sufficient mixing results, which conventional mixers are incapable of doing. A suitable mixer for the exemplary illustration could be manufactured, e.g., by means of a generative method (e.g. rapid prototyping).

Means could furthermore be provided in order particularly to flow through, coat and or to fill in particular the application device, the application element and/or the first and/or second nozzle with a solvent/rinsing agent, a reactive substance (e.g. a reaction delayer such as an organic acid chloride), which essentially stops or inhibits the hardening, and/or a monofunctional substance (e.g. propanol or butanol, in particular in the case of an isocyanate functionality), which reacts with the preservative agent and/or the hardener to essentially stop or inhibit the hardening (in particular in such a way that its chain reaction is essentially suppressed). The reactive substance and/or the monofunctional substance may thereby act as a blocking means in order to delay, or even to essentially prevent, the hardening of the preservative agent resp. of the mixture comprising preservative agent and hardener. It is possible for the mixture to comprise further components such as a solvent and/or rinsing agent.

An exemplary monofunctional substance may be a reactive, monofunctional substance which reacts with a preservative agent component and/or a hardener component, e.g., with a hardener component, wherein due to its monofunctionality does not lead to polymer chains but in the ideal case to a molecule resp. oligomer comprising a hardener molecule and two blocking agent molecules. Monofunctional substances to consider include, for example, amines or alcohols, low alcohols, e.g. ethanol, propanol, butanol and/or their isomers. The reactivity of the chain reaction, which may essentially be suppressed by the monofunctional substance, may be greater than that of the chain-forming reaction. Since e.g. bi- or multifunctional hardener molecules react with a short-chain monofunctional molecule, the viscosity of the mixture (preservative agent, hardener, monofunctional substance) may remain low.

The reactive substance as such may advantageously not penetrate the cavity to be preserved.

As mentioned above, the exemplary illustrations open up the possibility of forming the device in such a way that the preservative agent and the hardener can be mixed in the device, in the application device, in an application element, in a nozzle, outside the application device, outside an application element, outside outlet openings, in flight (in the air) and/or on the component to be preserved.

For example, the preservative agent line and the hardener line can discharge into the first and/or second application element in such a way that the mixing of the preservative agent and of the hardener is initiated in flight, on the component to be preserved and/or in the first nozzle.

It is furthermore possible to apply the preservative agent and the hardener simultaneously and/or sequentially.

It is also possible to arrange the application device on just one robot, e.g., on just a single robot arm. However, it is also possible to arrange the first application element on a first robot, preferably on the free end of a robot arm, and to arrange the second application element on a second robot, preferably on the free end of a second robot arm. For example, the robot or robots could be positioned along a conveying route for motor vehicle body components. The exemplary illustrations are not restricted to the above, however, but can also be used e.g. with hand-guided devices, semi-automatic systems, robot systems, waxing machines, etc.

Means can further be provided to atomize the preservative agent and/or the hardener.

Normally a cavity to be preserved has at least one opening out of which the preservative agent can undesirably escape again. The exemplary illustrations may also provide for the possibility of closing said opening by means of the preservative agent and the hardener. For this purpose, the preservative agent (with and/or without hardener) may be conveyed into the cavity to be preserved. The region around the opening may then be particularly targeted for provision of hardener. One advantage of this variant worth mentioning above all is the saving of hardener, i.e., by minimizing the amount of hardener needed. It is also possible to target the regions around the opening for provision of hardener without the need for the opening to close.

Alternatively, the opening in the cavity to be preserved can also be closed by means of a plug. The plug can be made of, for example, metal, plastic, rubber, wax or a self-soluble material (e.g. water soluble parts, ice etc.), which dissolves by itself once the preservative agent has dried.

The exemplary illustrations further comprise a method for preserving components, in particular for the cavity preservation of motor vehicle body components, e.g., with a device according to the exemplary illustrations, with which the advantages described above are achievable.

The method distinguishes itself in particular in that in addition to the preservative agent, a hardener may be applied to the component to be preserved, which hardener reacts with the preservative agent to cause the preservative agent to harden.

In one exemplary illustration, a wax can be used as the preservative agent while, e.g., isocyanate can be used as the hardener. The exemplary illustrations, however, can also be used with other components, e.g. various paints.

FIG. 1 is a schematic representation of a device for preserving components according to a first exemplary illustration, e.g., for preserving an inner surface of a cavity. The device is designed in order to apply in addition to a preservative agent a hardener to the component to be preserved, which hardener reacts with the preservative agent and causes the preservative agent to harden.

FIG. 1 shows in particular an application device 10. The application device 10 can be arranged on a robot arm (not shown), e.g., on the free end of the robot arm.

According to the first exemplary illustration the application device 10 comprises an application element 11. The application element 11 is may be an application tube, which, in terms of flow, essentially represents an end section of the device resp. the application device 10.

On the application element 11, a nozzle 12 may be provided. On the nozzle 12, an outlet opening 13 is provided. Furthermore, a preservative agent line 50 is provided for feeding a preservative agent 51 (e.g. wax) to the application device 10 and a hardener line 52 is provided for feeding a hardener (e.g. isocyanate) 53 to the application device 10.

In the first exemplary illustration, the preservative agent line 50 and the hardener line 52 discharge (open) into the application element 11, e.g., into the nozzle 12 provided on the application element 11. Thus, mixing of the preservative agent 51 and of the hardener 53 takes place in the application element 11, i.e. in such a way that the mixing of the preservative agent 51 and of the hardener 53 is initiated in the application element 11. M1 indicates said mixing region within the application element 11. Thus, there may advantageously be no mixing of the preservative agent 51 and hardener 53 upstream from the application element 11.

As shown in FIG. 1, the preservative agent line 50 and the hardener line 52 discharge into the nozzle 12, which is provided on the application element 11 in such a way that, in the first embodiment, mixing of the preservative agent 51 and of the hardener 53 takes place in the nozzle 12.

It is also possible that the preservative agent line 50 and the hardener line 52 discharge upstream, in particular immediately upstream from the nozzle 12, in such a way that mixing of preservative agent 51 and hardener 53 takes place in the application element 11, e.g., in an application tube, and the nozzle 12.

In the application tube 11 and/or the nozzle 12, a mini-mixer can be arranged if required.

Figure 2:
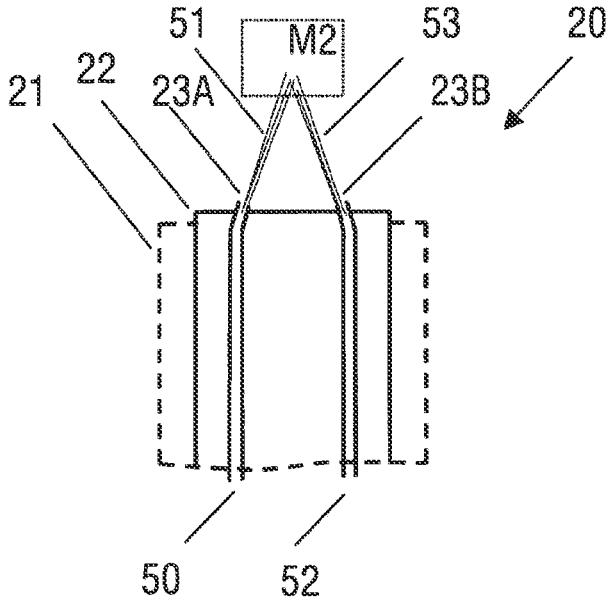
FIG. 2 a schematic representation of a device for preserving components according to a second exemplary illustration.

FIG. 2 is a schematic representation of a device according to a second exemplary illustration. Parts which are similar or identical to the first exemplary embodiment are provided with similar or identical reference numerals in such a way that reference can be made in the description to the first exemplary embodiment to avoid repetition.

FIG. 2 shows in particular an application device 20. According to the second exemplary illustration, the application device 20 comprises an application element 21. The application element 21 may be an application tube, which, in terms of flow, essentially represents an end section of the device resp. the application device 20.

On the application element 21, a nozzle 22 may be provided. On the nozzle 22, two outlet openings 23A and 23B are provided. Furthermore, a preservative agent line 50 is provided for feeding a preservative agent 51 to the application device 20 and a hardener line 52 for feeding a hardener 53 to the application device 20.

In the second exemplary illustration, the preservative agent line 50 leads to the first outlet opening 23A and the hardener line 52 leads to the second outlet opening 23B.

The nozzle 22 may include first and second outlet openings 23A and 23B, which may be arranged and/or be positionable in such a way that a mixing of the preservative agent 51 and of the hardener 53 takes place outside the application element 22, e.g., in the schematically represented region M2.

The mixing of the preservative agent 51 and of the hardener 53 thereby takes place in flight and/or on a surface to be preserved.

Figure 3:
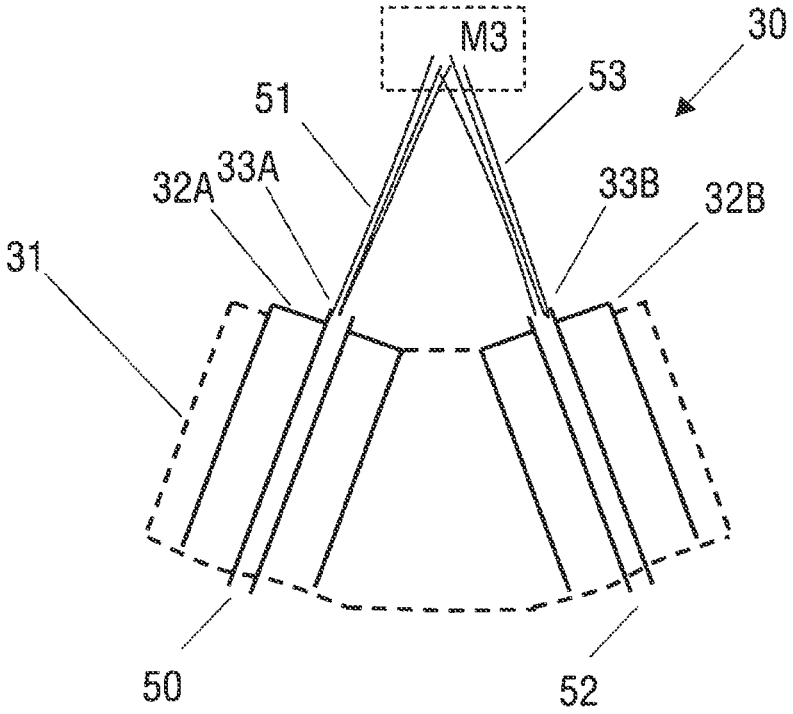
FIG. 3 a schematic representation of a device for preserving components according to a third exemplary illustration.

FIG. 3 is a schematic representation of a device according to a third exemplary illustration. Parts that are similar parts or identical to the first and/or second exemplary embodiment are provided with similar or identical reference numerals in such a way that reference can be made in the description to the first and/or second exemplary illustrations to avoid repetition.

FIG. 3 shows an application device 30. Similarly to the first and second exemplary embodiment, the application device 30 comprises an application element 31. The application element 31 may include an application tube, which, in terms of flow, essentially represents an end section of the application device 30.

The application element 31, however, has not just one nozzle but two nozzles 32A and 32B. The first nozzle 32A has a first outlet opening 33A and the second nozzle 32B has a second outlet opening 33B.

Furthermore, a preservative agent line 50 may be provided for feeding a preservative agent 51 to the application device 30 and a hardener line 52 for feeding a hardener 53 to the application device 30.

In the third exemplary illustration, the preservative agent line 50 leads to the first nozzle 32A resp. the first outlet opening 33A in such a way that the preservative agent 51 can be conveyed out of the first outlet opening 33A. The hardener line 52 leads to the second nozzle 32B resp. the second outlet opening 33B, in such a way that the hardener 53 can be conveyed out of the second outlet opening 33B.

The first and second nozzles 32A and 32B, as well as the first and second outlet openings 33A and 33B thereof, respectively, may be arranged and/or be positionable in such a way that a mixing of the preservative agent 51 and of the hardener 53 takes place outside the application element 31, e.g., in the schematically represented region M3.

Mixing of the preservative agent 51 and of the hardener 53 thereby takes place in flight and/or on a surface to be preserved.

Figure 4:
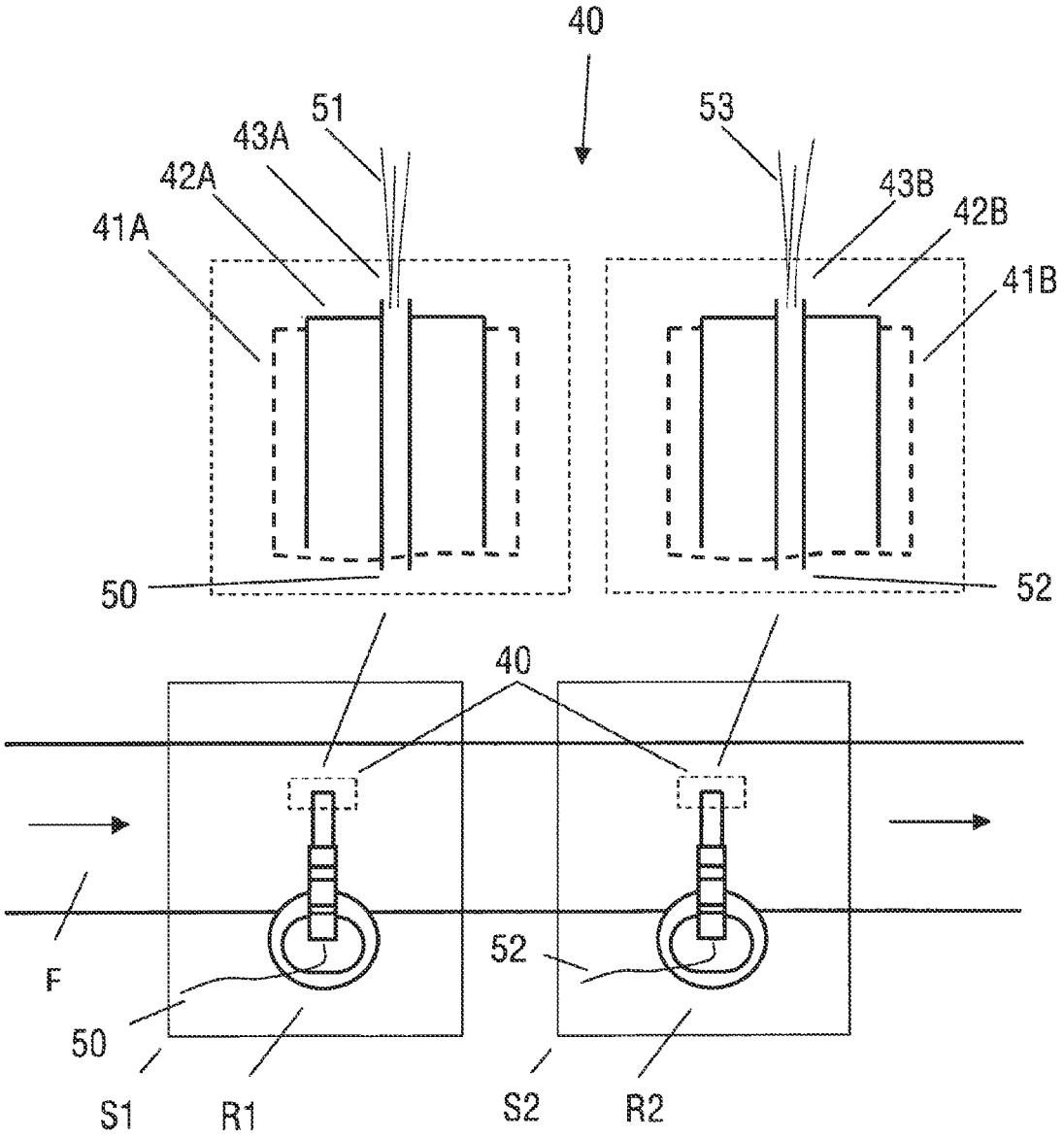
FIG. 4 a schematic representation of a device for preserving components according to a fourth exemplary illustration.

FIG. 4 is a schematic representation of a device according to a fourth example, which is arranged along a conveying route F for motor vehicle body components. Similar or identical parts to the first, second and/or third exemplary embodiments are provided with similar or identical reference numerals in such a way that reference can be made to the descriptions for these exemplary embodiments to avoid repetition.

FIG. 4 essentially shows an application device 40 which is, on the one hand, shown on robots R1, R2 and, on the other hand, shown enlarged. Unlike the previous exemplary illustrations, the application device 40 has two separate application elements 41A and 41B, each of which can be, for example, an application tube. In terms of flow, the application element 41A and the application element 41B respectively represent essentially end sections of the device resp. the application device 40.

The first application element 41A can be arranged on a robot arm of a robot R1, e.g., on its free end, whereas the second application element 41B can be arranged on a robot arm of another robot R2, e.g., on its free end.

The first application element 41A comprises a first nozzle 42A on which a first outlet opening 43A is provided. The second application element 41B comprises a second nozzle 42B on which a second outlet opening 43B is provided.

Furthermore, a preservative agent line 50 is provided for feeding a preservative agent 51 to the application device 40 and a hardener line 52 for feeding a hardener 53 to the application device 40.

In the fourth exemplary illustration, the preservative agent line 50 discharges to the first nozzle 42A resp. the first outlet opening 43A, in such a way that the preservative agent 51 can be conveyed out of the first outlet opening 43A. The hardener line 52 discharges to the second nozzle 42B resp. the second outlet opening 43B, in such a way that the hardener 53 can be conveyed out of the second outlet opening 43B.

The device for cavity preservation according to the fourth exemplary illustration may be arranged on the conveying route F for transporting motor vehicle body components. The first application element 41A can then be provided in a preservative agent application station S1 and the second application element 41B can be provided in a hardener application station S2. In this process, the hardener application station S2 could be positioned directly downstream from the preservative agent application station S1.

The material, in particular the preservative agent and the hardener, could be matched in such a way that only a defined spreading time is possible after the addition of the hardener. After the preservative agent, e.g., a wax, has penetrated, the spreading should be stopped very quickly ("drop-stop"). The hardener application station S2, however, could also be positioned at a distance from the preservative agent application station S1 in accordance with the process time of the penetration. The hardener could then react without delay to initiate the "drop-stop".

The first and second nozzles 42A and 42B resp. the first and second outlet openings 43A and 43B are provided in such a way that a mixing of the preservative agent 51 and of the hardener 53 can take place outside the application device 40.

The discharge of preservative agent 51 and hardener 53 may be sequential, i.e., in a first step the first application element 41A applies the preservative agent 51 to the component to be preserved and in a second step the second application element 41B applies the hardener 53 to the component to be preserved. Thus, mixing of the preservative agent 51 and of the hardener 53 takes place on the component to be preserved.

The application device can thus have one application element or a plurality of application elements. In terms of flow, the application device may essentially represent an end section of the device. In terms of flow, the application element/s may be arranged downstream from the application device and may essentially represent an end section of the device. The application element/s may be formed in such a way that it/they can position one or a plurality of outlet openings on hard-to-reach surfaces to be preserved e.g. cavities to be preserved, undercuts, etc.

According to the exemplary illustrations, means can be provided to atomize the preservative agent and/or the hardener, in any manner that is convenient. For example, means for atomizing the preservative agent and/or hardener are generally described in the disclosure of DE 103 22 170 A1 and corresponding EP Pat. Pub. No. 1 477 231, the content of which is to be included in full in the present description.

The exemplary illustrations are generally usable in manual systems, semi-automatic systems, robot systems, waxing machines, etc. In manual systems or semi-automatic systems, a worker may generally guide the corresponding nozzle/s and/or outlet opening/s into the cavity to be preserved and starts the coating process manually. The material quantity can be metered automatically in this process. After completion of the process, the nozzle is conveyed to the next opening and the process is repeated. There are often different nozzles and material quantities and the further process parameters are different for different components on the vehicle. A controller can provide information with respect to the nozzle/s to be used, whether and when the nozzle should be changed, the adjustment of relevant parameters, etc. After stripping (start), the coating can proceed fully automatically.

Robot systems are generally used where a high degree of flexibility is required, e.g. body variants, low number of units, changes, etc. The robots may have interchangeable heads with one or a plurality of nozzles per head, which interchangeable heads hold the nozzle heads according to the body opening and convey them to the corresponding body openings. The coating can proceed fully automatically.

In the case of waxing machines, the body is generally positioned (centred) mechanically. By means of a mechanism, the nozzle/s is/are then inserted into the body openings and the wax is applied. These systems may generally work fully automatically.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than those specifically provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. An application device, comprising:

a preservative agent line arranged to feed a preservative agent and a hardener line arranged to feed a hardener;

a first nozzle in fluid communication with the preservative agent line and a second nozzle in fluid communication with the hardener line;

a reactive substance, which at least inhibits the hardening, the reactive substance provided to flow through, coat, and/or fill the application device including at least one of the first nozzle and the second nozzle; and a monofunctional substance, which reacts with at least one of the preservative agent and the hardener, to at least inhibit the hardening, the monofunctional substance provided to flow through, coat, and/or fill the application device including at least one of the first nozzle and the second nozzle;

wherein the device is arranged to flow at least one of a solvent and a rinsing agent through at least one of the first nozzle and the second nozzle; and wherein the device is arranged to apply the preservative agent and the hardener to a component.

2. The device according to claim 1, further comprising at least one first application element with at least one first outlet opening.

3. The device according to claim 2, wherein the first application element has at least one of the first nozzle and the second nozzle on which the first outlet opening is provided.

4. The device according to claim 3, wherein the preservative agent line and the hardener line discharge into the first application element in such a way that the preservative agent and the hardener can be mixed in the first application element.

5. The device according to claim 3, wherein the preservative agent line and the hardener line discharge into the first application element in such a way that the preservative agent and the hardener can be mixed upstream from the first nozzle or in the first nozzle.

6. The device according to claim 3, wherein a second outlet opening is provided on the first nozzle.

7. The device according to claim 3, wherein the first application element has the second nozzle on which is provided a second outlet opening.

8. The device according to claim 7, wherein the preservative agent line leads to the first outlet opening and the hardener line leads to the second outlet opening in such a way that the preservative agent and the hardener mix in flight or on the component to be preserved.

9. The device according to claim 2, further comprising a second application element with at least one second outlet opening.

10. The device according to claim 9, wherein the second outlet opening is provided on the second nozzle.

11. The device according to claim 9, wherein the preservative agent line leads to the first outlet opening and the hardener line leads to the second outlet opening in such a way that the preservative agent and the hardener can be mixed in flight or on the component to be preserved.

12. The device according to claim 9, wherein the first application element is arranged on a preservative agent application station and the second application element is arranged on a hardener application station, wherein the preservative agent application station and the hardener application station are positioned along a conveying route for motor vehicle body components.

13. The device according to claim 9, wherein:

at least one of the first application element and the second application element is arranged to be guided into a cavity to be preserved; and at least one of the first application element and the second application element is an application tube or a probe.

14. The device according to claim 9, wherein the preservative agent line and the hardener line discharge into at least one of the first and the second application element in such a way that the mixing of the preservative agent and of the hardener is initiated in at least one of the following:

in flight;

on the component to be preserved;

in the first application element; and in the first nozzle.

15. The device according to claim 1, further comprising a mixer disposed in at least one of a first application element; and the first nozzle.

16. The device according to claim 1, wherein the device is arranged to mix the preservative agent and the hardener in at least one of the following:

in the device;

in the application device;

in a first application element;

in the first nozzle;

outside the application device;

outside at least one of the first and a second application element;

outside at least one of first and second outlet openings;

in flight; and on the component to be preserved.

17. The device according to claim 1, wherein the device is configured such that application of the preservative agent and of the hardener can be executed simultaneously or sequentially.

18. The device according to claim 1, wherein at least one of a first robot arm and a second robot arm is arranged along a conveying route for motor vehicle body components; and at least one of a first application element and a second application element is arranged on at least one of the first and the second robot arm.

19. The device according to claim 1, wherein the device is arranged to atomize at least one of the preservative agent and the hardener.

20. The device according to claim 1, wherein the device is adapted for cavity preservation of motor vehicle body components.

21. The device according to claim 1, wherein the preservative agent is a wax.

* * * * *